US010762880B1

(12) United States Patent
Martelli

(10) Patent No.: US 10,762,880 B1
(45) Date of Patent: Sep. 1, 2020

(54) UNDER BRIDGE APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 0 days.

(21) Appl. No.: 16/176,071

(22) Filed: Oct. 31, 2018

Related U.S. Application Data

(60) Provisional application No. 62/595,163, filed on Dec. 6, 2017.

(51) Int. Cl.
*G10D 3/04* (2020.01)
*G10D 3/10* (2006.01)
*G10D 3/06* (2020.01)

(52) U.S. Cl.
CPC ..... *G10D 3/04* (2013.01); *G10D 3/06* (2013.01); *G10D 3/10* (2013.01)

(58) Field of Classification Search
CPC ..... G10D 3/04; G10D 3/06; G10D 3/10
See application file for complete search history.

(56) References Cited

U.S. PATENT DOCUMENTS 4,031,801 A * 6/1977 Cecchini ..... G09B 15/06 84/465
6,426,454 B1 * 7/2002 Gregory ..... G10D 1/00 84/267
2018/0033409 A1 * 2/2018 Colas ..... G10D 3/04

* cited by examiner

*Primary Examiner* — Kimberly R Lockett
(74) *Attorney, Agent, or Firm* — J. Nevin Shaffer, Jr.

(57) ABSTRACT

An under bridge, with a top and a bottom, a front and a back and a first end and a second end. An attachment device is connected with the under bridge where the attachment device is configured to attach the under bridge to a musical instrument such that when attached to a musical instrument the bottom of the under bridge is above the musical instrument and a space is created between the bottom of the under bridge and the musical instrument. A string retainer slot is provided in the bottom of the under bridge.

20 Claims, 3 Drawing Sheets

UNDER BRIDGE APPARATUS AND METHOD

CROSS REFERENCE TO RELATED APPLICATION

This application claims the benefit of previously filed U.S. provisional patent application No. 62/595,163 filed Dec. 6, 2017 for a "Guitar Under Bridge Apparatus and Method". The Applicant hereby claims the benefit of this provisional application under 35 U.S.C. § 119. The entire content of this provisional application is incorporated herein by this reference.

FIELD OF THE INVENTION

This invention relates to a musical instrument under bridge apparatus and method. In particular, in accordance with one embodiment, the invention relates to an under bridge, with a top and a bottom, a front and a back and a first end and a second end. An attachment device is connected with the under bridge where the attachment device is configured to attach the under bridge to a musical instrument such that when attached to a musical instrument the bottom of the under bridge is above the musical instrument and a space is created between the bottom of the under bridge and the musical instrument. A string retainer slot is provided in the bottom of the under bridge.

BACKGROUND OF THE INVENTION

A problem exists with regard to the use of stringed musical instruments in that in order to play different notes or chords, a string must be pressed down against upward pressure of the tensioned string. That is, the state of the art for stringed musical instruments, for example only and not by way of limitation, as with a guitar, violin, etc., includes a head stock connected at an obtuse angle with the neck of the guitar such that the head stock is angled toward the bottom of the body of the guitar. A string is attached to the bridge on the guitar body on one end and with the head stock at the other. According to the prior art, the guitar string in the prior art passes over the "nut", or for purposes of discussion herein the "over bridge", located at the junction of the head stock and the upper or first end of the neck. This arrangement pulls the string over the top of the nut/over bridge and supports the guitar string above frets in the neck. Again, currently, to play a chord a user must press the guitar string down against the upward pressure of the over bridge/nut. This may change the tuning of the chord over time and is so difficult to do that it causes blisters and callouses to develop.

Thus, there is a need in the art for an improved stringed musical instrument assembly that allows chords to be played more easily, that maintains tuning longer and that is easy to assemble and use.

It therefore is an object of this invention to provide an improved musical instrument apparatus and method that allows chords to be played more easily, that maintains tuning longer and that is easy to assemble and use.

SUMMARY OF THE INVENTION

Accordingly, the under bridge apparatus of the present invention, according to one embodiment, includes an under bridge, with a top and a bottom, a front and a back and a first end and a second end. An attachment device is connected with the under bridge where the attachment device is configured to attach the under bridge to a musical instrument such that when attached to a musical instrument the bottom of the under bridge is above the musical instrument and a space is created between the bottom of the under bridge and the musical instrument. A string retainer slot is provided in the bottom of the under bridge.

All terms used herein are given their common meaning such that all the references to elements found on a stringed musical instrument such as a guitar, used for example only and not by limitation, are as known in the art. As used herein the unique term "under bridge" of the present invention is used to identify a "nut" as that term is used in the art, where it is configured such that a string passes underneath it and not over it as is the function of nuts known in the art.

In one aspect, the apparatus further includes an attachment base where the attachment base is removably connectable with the attachment device with the musical instrument in between.

In another aspect, the first end and the second end of the under bridge extend beyond the bottom of the under bridge and are configured to connect with a musical instrument and support the bottom of the under bridge above the musical instrument.

According to another embodiment of the invention, in a musical instrument, an under bridge apparatus includes a musical instrument with a head stock, a neck with a first end and a second end, a bridge and a body where the body has a front and a back. The head stock forms an angle with the first end of the neck such that the head stock is angled toward the front of the body. An under bridge, with a top and a bottom, a front and a back and a first end and a second end, is connected with the musical instrument between the head stock and the neck such that the bottom of the under bridge is spaced apart from the musical instrument and a space is created between the bottom of the under bridge and the musical instrument.

In one aspect, the first end and the second end extend beyond the bottom of the under bridge and are configured to connect with the musical instrument such that the space is created between the bottom of the under bridge and the musical instrument.

In another aspect, the apparatus further includes a string with a first end and a second end where the first end is connected with the bridge and where the second end passes under the under bridge and is connected with the head stock such that the string contacts the bottom of the under bridge.

In one aspect, the under bridge includes a string retainer slot in the bottom of the under bridge where the string is retained within the string retainer slot. In another aspect, there are more than one string retainer slots and more than one string and in another aspect there are six string retainer slots and six strings.

In a further aspect, the under bridge includes an attachment base where the attachment base is attached underneath the neck and to the under bridge with the neck in between.

In one aspect, the head stock forms an acute angle with the first end of the neck.

In another aspect, the musical instrument is a guitar.

According to another embodiment, in musical instruments, an under bridge method consists of:

a. providing an under bridge, with a top and a bottom, a front and a back and a first end and a second end; an attachment device connected with the under bridge where the attachment device is configured to attach the under bridge to a musical instrument where, when attached to the musical instrument, the bottom of the under bridge is above the musical instrument and a space is created between the bottom of the under bridge and the musical instrument; and a string retainer slot in the bottom of the under bridge; and b. connecting the under bridge to a musical instrument.

In one aspect, the musical instrument includes a head stock, a neck with a first end and a second end, a bridge and a body, where the body has a front and a back and includes connecting the head stock with the neck such that the head stock forms an angle with the first end of the neck such that the head stock is angled toward the front of the body.

In another aspect, the method further includes providing a string with a first end and a second end where the first end is connected with the bridge and where the second end passes under the under bridge and is retained in the string retainer slot and is connected with the head stock such that the string contacts the bottom of the under bridge.

In other aspects, there are more than one string retainer slot and more than one string and there are six string retainer slots and six strings.

In a further aspect, connecting the head stock with the neck forms an acute angle with the first end of the neck such that the head stock is angled toward the front of the body.

In further aspects, the musical instrument is a guitar and/or the musical instrument is selected from a group consisting of: guitars and violins.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
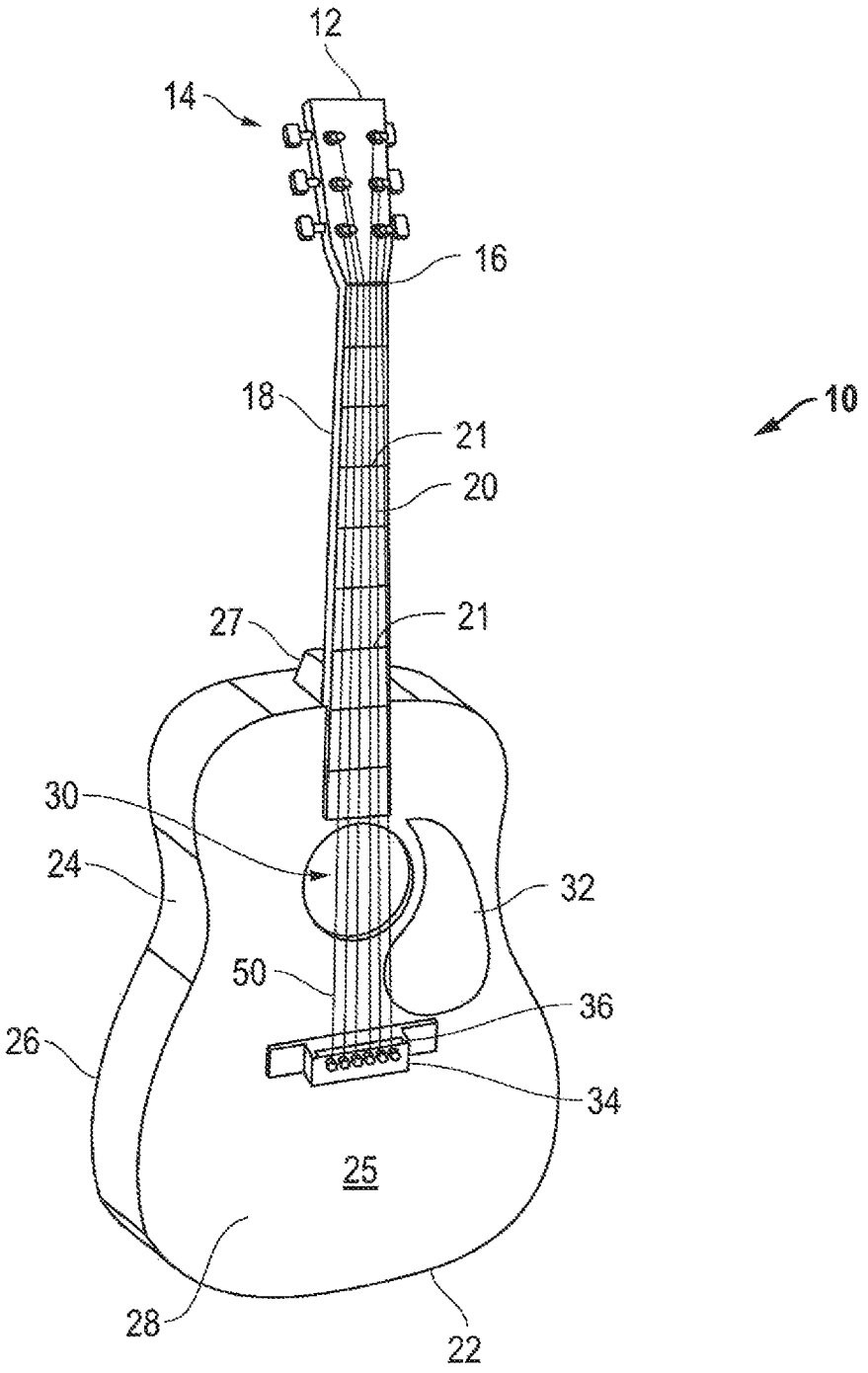
FIG. 1 (Prior Art)
FIG. 1 is a perspective view of a Prior Art stringed musical instrument.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described method may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

Figure 2:
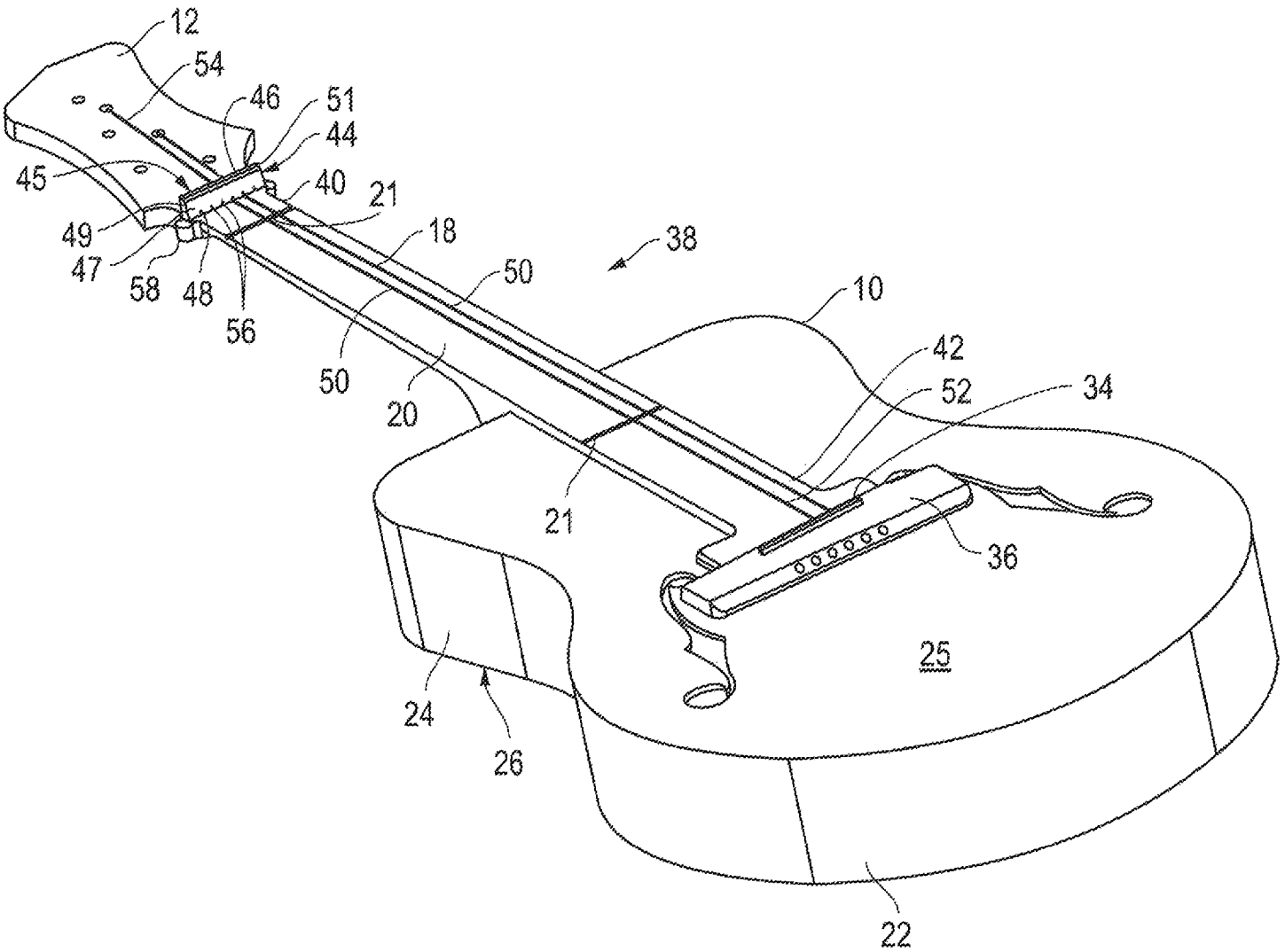
FIG. 2 is a perspective view of a musical instrument including an under bridge of the present invention.
Figure 3:
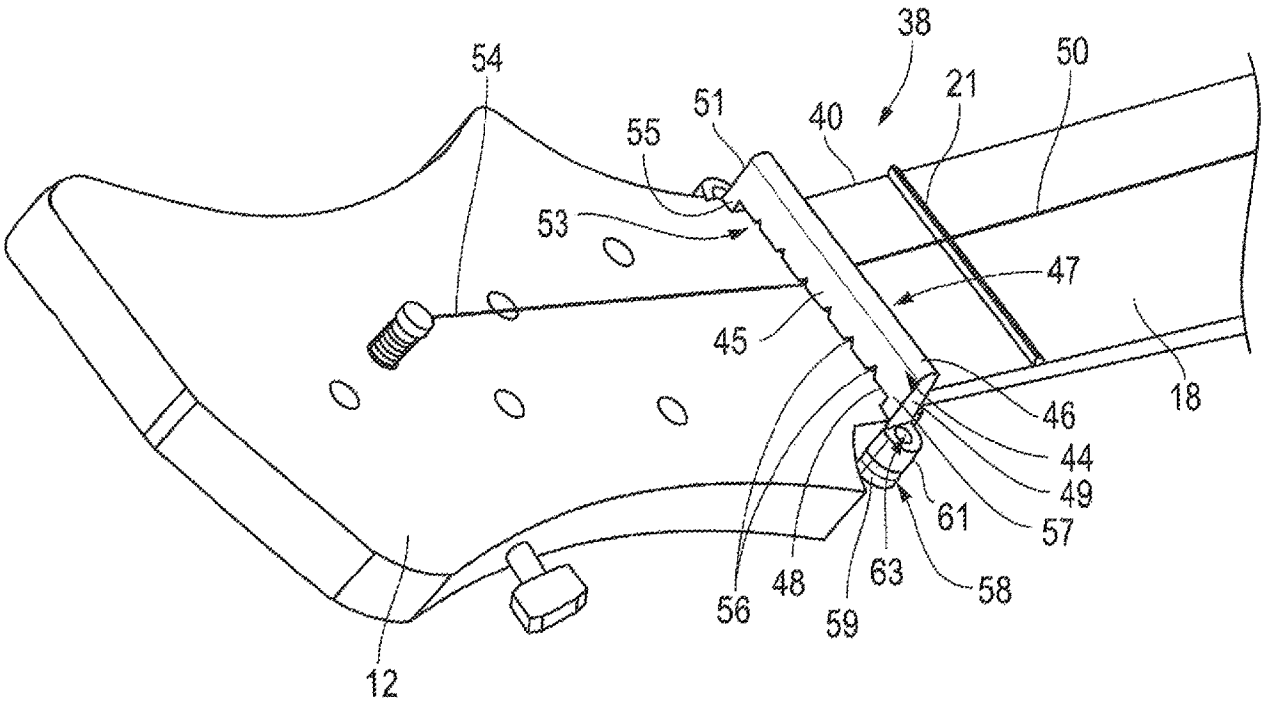
FIG. 3 is a close up perspective view of the invention of FIG. 2 showing the head stock, under bridge and first end of the neck with a string passing underneath the under bridge.
Figure 4:
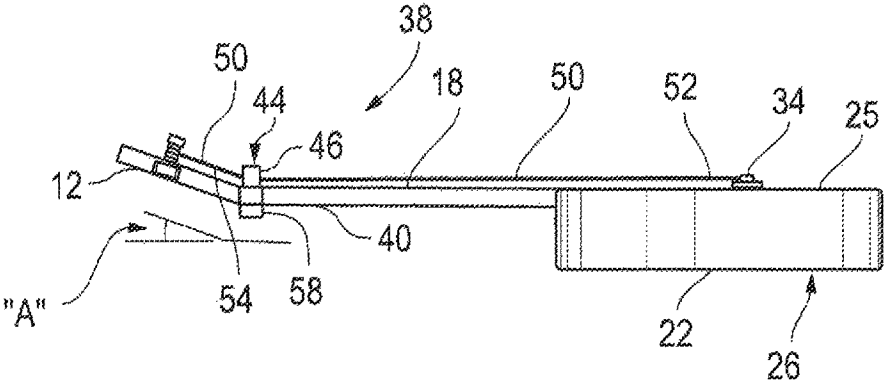
FIG. 4 is a side view of the invention of FIG. 2 showing a string held up against the bottom of the under bridge as a result of the head stock connected to the neck at an angle toward the front of the body.

The preferred embodiment of the present invention is illustrated by way of example in FIGS. 2-4. With specific reference to Prior Art FIG. 1, for purposes of explanation of the present invention, stringed musical instrument 10, such as a guitar for example only and not by limitation, has a head stock 12, machine heads 14, nut ("over bridge") 16, neck 18, fret board 20, frets 21, body 22, sides of body 24, front of body 25 and back of body 26, heel 27, sound board 28, sound hole 30, pic guard 32, bridge 34 and bridge saddle 36 all as are known in the art. Importantly, head stock 12 of the prior art is connected with the neck 18 such that it is angled toward the back 26 of the body 24. Further, the prior art string(s) 50 are connected at one end to bridge 34 and pass over the top of nut (over bridge) 16.

Referring now to FIG. 2, the under bridge apparatus 38 of the present invention shown in use with a stringed musical instrument 10, such as a guitar, with a head stock 12, a neck 18 with a first end 40 and a second end 42, a bridge 34 and a body 22, with a front 25 and back 26, all as before where, however, the head stock 12 is connected with the first end 40 of neck 18 at an angle (as more clearly shown in FIG. 4) with the first end 40 of the neck 18 such that the head stock is angled toward the front 25 of body 22.

An under bridge 44, with a top 46 and a bottom 48, a front 45 and a back 47 and a first end 49 and a second end 51 is connected with the musical instrument 10 between the head stock 12 and the neck 18, as shown, such that the bottom 48 of the under bridge 44 is spaced apart from the musical instrument 10. The term "spaced apart" describes a relationship where the bottom 48 of the under bridge 44 is located above the connection with the musical instrument 10 but not touching it and leaving a space 53 between the bottom 48 and the musical instrument 10 as more clearly shown in FIGS. 3 and 4.

Preferably, first end 49 and second end 51 of under bridge 44 are structured such that they extend beyond the bottom 48 of under bridge 44 and create "post like" extensions 55 and 57 (more clearly shown in FIG. 3) that contact or connect with the surface of musical instrument 10 as illustrated and support the bottom 48 of under bridge 44 above the surface of musical instrument 10. In this manner, space 53 is created and maintained as required by the present invention. Certainly other structures are available to accomplish this required space 53.

Preferably, in use, the invention further includes a string 50 with a first end 52 and a second end 54 where the first end 52 is connected with the bridge 34 and where the second end 54 passes under the under bridge 44 and is connected with the guitar head stock 12 such that the guitar string 50 contacts the bottom 48 of the under bridge 44. This unique structure holds the string(s) 50 in place and allows tuning, etc. as before but results in reduced resistance when a user presses the string 50 down toward the fret board 20. Applicant has determined that it is easier to play and less damaging to a user's fingers than the long established prior art structure.

FIGS. 2 and 3 show that preferably the under bridge 44 includes a string retainer slot 56 in the bottom 48 of the under bridge 44 where the string 50 is retained within, and held in position by, the string retainer slot 56. In a further aspect, there are more than one string retainer slots 56 and more than one string 50 and in one aspect, there are six string retainer slots 56 and six strings 50, for example only and not by limitation, as shown in the Figures.

FIG. 3 illustrates that in one aspect, the under bridge 44 includes an attachment base 58 where the attachment base 58 is attached underneath the neck 18 and to the under bridge 44 with the neck 18 in between as illustrated in the Figures. The attachment base 58 allows precise location of the under bridge 44 not heretofore available in prior art devices. Preferably, attachment base 58, as illustrated, includes attachment device 59 and, preferably, under bridge 44 includes a similar attachment device 61 as illustrated. Attachment devices 61 and 59 preferably include female receptor holes 63 into which a screw or bolt, not shown for clarity, is secured so as to connect attachment base 58 with under bridge 44. In this manner, attachment base 58 is removably connected to under bridge 44 and then to the musical instrument 10 in any desired location. Certainly, attachment base 58 and under bridge 44 may be removably or permanently connected in any manner by any attachment device now known or hereafter developed.

Referring now to FIG. 4, the acute angle "A" is clearly shown as required in the connection of the head stock 12 to neck 18 such that the head stock 12 is angled toward the front 25 of the body 22 according to the unique structure of the present invention. The objective function of the angle, whether acute or not, is to provide an anchor location for the string 50 on the head stock 12 such that the string 50 is forced up against the bottom 48 of the under bridge 44. As a result, the attachment angle is not limited to the preferred acute angle illustrated.

By way of further explanation, in the prior art, nut 16 (over bridge), on a stringed musical instrument 10, is a small piece of hard material that supports the strings 50 at the end closest to the head stock 12 or scroll. The nut 16 marks one end of the vibrating length of each string 50, sets the spacing of the strings across the neck 18, and usually holds the strings 50 at the proper height above the fingerboard/fret board 20. Along with the bridge 34, the nut 16 (over bridge) defines the vibrating lengths (scale lengths) of the strings 50.

To play most chords, the prior art requires a user to press down on the strings 50 with the tips of their fingers (not shown). This allows a user to apply maximum pressure to get the cleanest sound possible. Further the user must press down on string 50 with just the tip of the finger for maximum pressure and avoid touching other strings that shouldn't be pressed.

A traditional nut 16 (over bridge), with the string 50 passing over the top of the nut 16 and down to the head stock 12, adds tension to the string 50 allowing it to hold pitch, but when pressed down to make a note or chord, the user adds more tension to the string 50 in order to make the note or chord ring out. Therefore, it's very hard to press down on the strings 50 for many beginners. This method also causes calluses and blisters to occur, thus making many beginners quit the instrument.

Importantly and uniquely, the present invention reverses the angle of the head stock 12 and reverses the nut 16 from an "over bridge" to an "under bridge" such that pressing a string in a downward position is easier in that a player uses gravity as an ally. The under bridge 44 of the present invention allows the tension of the string to be less because the string 50 is bent or pressed away from the nut 16 (under bridge 44) not over it, making it easier to play the note. In another advantage provided by the present invention, testing indicates that it increases the life and strength of the string 50.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In musical instruments, an under bridge apparatus comprising:

a. an under bridge, with a top and a bottom, a front and a back and a first end and a second end wherein the first end and the second end of the under bridge extend beyond the bottom of the under bridge and are configured to connect with a musical instrument and, support said bottom of said under bridge above the musical instrument;

b. an attachment device connected with said under bridge wherein said attachment device is configured to attach said under bridge to a musical instrument wherein when attached to said musical instrument the bottom of said under bridge is above the musical instrument and a space is created between the bottom of the under bridge and, the musical instrument; and c. a string retainer slot in the bottom of the under bridge.

2. The apparatus of claim 1 wherein said under bridge includes an attachment base wherein said attachment base is removably connectable with the attachment device with said musical instrument in between.

3. In a musical instrument, an under bridge apparatus comprising:

a. a musical instrument with a head stock, a neck with a first end and a second end, abridge and a body wherein the body has a front and aback;

b. wherein said head stock forms an angle with the first end of the neck such that the head stock is angled toward the front of the body; and c. an under bridge, with a top and a bottom, a front and a back and a first end and a second end, wherein the first end and the second end extend beyond the bottom of the under bridge and are configured to connect with the musical instrument such that a space is created between the bottom of said under bridge and the musical instrument, connected with said musical instrument between said head stock and said neck such that the bottom of said under bridge is spaced apart from the musical instrument and said space is created between the bottom of the under bridge and the musical instrument.

4. The apparatus of claim 3 further including a string with a first end and a second end wherein said first end is connected with said bridge and Wherein said second end passes under said under bridge and is connected with said head stock such that said string contacts the bottom of the under bridge.

5. The apparatus of claim 3 wherein said under bridge includes a string retainer slot in the bottom of the under bridge wherein said string is retained within said string retainer slot.

6. The apparatus of claim 5 wherein there are more than one string retainer slots and more than one string.

7. The apparatus of claim 6 wherein, there are six string retainer slots and six strings.

8. The apparatus of claim 3 wherein said under bridge includes an attachment base wherein said attachment bases attached underneath said neck and to said under bridge with said neck in between.

9. The apparatus of claim 3 wherein said head stock forms an acute angle with the first end of the neck.

10. The apparatus of claim 3 where the musical instrument is a guitar.

11. In musical instruments, an under bridge method comprising:

a. providing an under bridge, with a top and a bottom, a front and a back and a first end and a second end wherein the first end and the second end of the under bridge extend beyond the bottom of the under bridge and are configured to connect with a musical instrument and support said bottom of said under bridge above the musical instrument; an attachment device connected with said under bridge wherein said attachment device configured to attach said under bridge to a musical instrument wherein when attached to said musical instrument the bottom of said under bridge is above the musical instrument and a space is created between the bottom of the under bridge and the musical instrument; and a string retainer slot in the bottom of the under bridge; and b. connecting said under bridge to a musical instrument.

12. The method of claim 11 wherein the musical instrument includes a head stock, a neck with a first end and a second end, a bridge and a body, wherein the body has a front and a back; and b. connecting said head stock with said neck such that said head stock forms an angle with the first end of the neck such that the head stock is angled toward the front of the body.

13. The method of claim 12 further including providing a string with a first end and a second end wherein said first end is connected with said bridge and wherein said second end passes under said under bridge and is retained in said string retainer slot and is connected with said head stock such that said string contacts the bottom of the under bridge.

14. The method of claim 13 wherein there are more than one string retainer slot and more than one string.

15. The method of claim 14 wherein there are six string retainer slots and six strings.

16. The method of claim 11 wherein connecting said head stock with said neck forms an acute angle with the first end of the neck such that the head stock is angled toward the front of the body.

17. The method of claim 11 wherein the musical instrument is a guitar.

18. The method of claim 11 wherein the musical instrument is selected from a group consisting of: guitars and violins.

19. In a musical instrument, an under bridge apparatus comprising;

a. a musical instrument with a head stock, a neck with a first end and a second end, a bridge and a body wherein the body has a from and a back;

b. wherein said head stock forms an angle with the first end of the neck such that the head stock is angled toward the front of the body; and c. an under bridge, with a top and a bottom, a front and a back and a first end and a second end, connected, with said musical instrument between said head stock and said neck such that the bottom of said under bridge is spaced apart from the musical instrument and a space is created between the bottom of the under bridge and the musical instrument and wherein said under bridge includes an at base wherein said attachment base is attached underneath said neck and to said under bridge with said neck in between.

20. The apparatus of claim 19 further including a string with a first end and a second end wherein said first end is connected with said bridge and wherein said second end passes under said under bridge and is connected with said head stock such that said string contacts the bottom of the under bridge.

* * * * *